US006609507B2

(12) United States Patent
Wilkinson

(10) Patent No.: US 6,609,507 B2
(45) Date of Patent: Aug. 26, 2003

(54) SECOND STRIKE IGNITION SYSTEM

(75) Inventor: Roger Wilkinson, Covina, CA (US)

(73) Assignee: Pertronix, Inc., San Dimas, CA (US)

( * ) Notice: Subject to any disclaimer, the term of this patent is extended or adjusted under 35 U.S.C. 154(b) by 156 days.

(21) Appl. No.: 09/932,075

(22) Filed: Aug. 20, 2001

(65) Prior Publication Data

US 2003/0034017 A1 Feb. 20, 2003

(51) Int. Cl.[7] ..... F02P 3/02
(52) U.S. Cl. ..... 123/620; 123/618; 123/406.53
(58) Field of Search ..... 123/618, 620, 123/643, 335, 406.53

(56) References Cited

U.S. PATENT DOCUMENTS

| | | | | |
|---|---|---|---|---|
| 3,874,354 A | | 4/1975 | Crouch | |
| 3,933,140 A | | 1/1976 | Gynn | |
| 4,058,103 A | | 11/1977 | Brocker | |
| 4,149,508 A | | 4/1979 | Kirk, Jr. et al. | |
| 4,224,917 A | | 9/1980 | Nakazawa et al. | |
| 4,235,213 A | | 11/1980 | Jellissen | |
| 4,345,575 A | | 8/1982 | Jorgensen | |
| 4,365,609 A | | 12/1982 | Toyama et al. | |
| 4,406,272 A | | 9/1983 | Kiess et al. | |
| 4,478,201 A | | 10/1984 | Asik | |
| 4,499,888 A | | 2/1985 | Hino et al. | |
| 4,508,092 A | | 4/1985 | Kiess et al. | |
| 4,522,185 A | | 6/1985 | Nguyen | |
| 4,901,704 A | | 2/1990 | Safranek | |
| 4,941,445 A | * | 7/1990 | Deutsch | 123/406.18 |
| 5,028,868 A | | 7/1991 | Murata et al. | |
| 5,058,559 A | | 10/1991 | Koiwa | |
| 5,076,249 A | | 12/1991 | Ikeuchi et al. | |
| 5,093,617 A | | 3/1992 | Murata et al. | |
| 5,097,209 A | | 3/1992 | Santos | |
| 5,126,663 A | | 6/1992 | Shinjo | |
| 5,127,387 A | | 7/1992 | Matsuo | |
| 5,158,056 A | | 10/1992 | King | |
| 5,197,448 A | | 3/1993 | Porreca et al. | |
| 5,365,909 A | | 11/1994 | Sawazaki | |
| 5,406,926 A | | 4/1995 | Gu | |
| 5,638,799 A | | 6/1997 | Kiess et al. | |
| 5,803,059 A | | 9/1998 | Jacobs et al. | |
| 6,050,242 A | | 4/2000 | Wilkinson | |
| 6,123,063 A | | 9/2000 | Boerjes | |
| 6,131,555 A | * | 10/2000 | Tozzi et al. | 123/618 |
| 6,186,114 B1 | * | 2/2001 | Nakamura | 123/335 |
| 6,195,522 B1 | * | 2/2001 | Sato | 399/284 |
| 6,425,383 B1 | * | 7/2002 | Raeske et al. | 123/643 |

OTHER PUBLICATIONS

"Ignitor Better Fuel Economy" Advertisement of Pertronix, Inc.
"Never Change Points Again" Advertisement of Petronix, Inc.

(List continued on next page.)

*Primary Examiner*—John Kwon
(74) *Attorney, Agent, or Firm*—Don Finkelstein

(57) ABSTRACT

A supplementary ignition system in an internal combustion engine having an induction coil ignition systems of the type in which a first spark signal is generated to provide a single second spark signal a predetermined time after the start of the first spark signal. The invention supplements and does not alter or affect the first spark signal the first spark signal provided by the primary ignition system for the internal combustion engine. Augmentation with the second strike ignition system results in a longer duration and higher quality double strike spark at the spark plug of the engine during the compression stroke of the engine to provide more complete combustion of the fuel/air mixture in each cylinder of the engine. Being a supplemental ignition system, it can be removed at any time with immediate reversal back to the original equipment and its performance.

37 Claims, 6 Drawing Sheets

OTHER PUBLICATIONS

"Ignitor Electronic Ignition" Catalog of Petronix, Inc., p. 40.
"European Car", Apr. 1994, p. 8.
"All Chevy", Feb., 1994.
"VW Trends", Apr. 1994.
"Super Chevy", Jun. 1994.
"Musclecar Resoration & Performance", Jun. 1993, p. 76, ET Sec.
"Hide Some Horses Under Your Cap", Advertisement of Pertronix, Inc.

* cited by examiner

COIL (-)
(11) PRIMARY SPARK
(31) INT
(33) "ON" TO DC-DC CONV
(35) ACTIVATE ENERGY GATE
(37) READ "S & H"
ADD CONVERT TO DIGITAL
(39) DAC TO DC
(41) READ "ON/OFF"
TURN DC-DC ON
(43) READ SWITCHES
(45) TACH OUT
COIL (-)
COMPOSITE
(16) SPARK
12
13
CTO
ON
OFF
CRANK TIME
OFFSET
500μ SEC
15
12

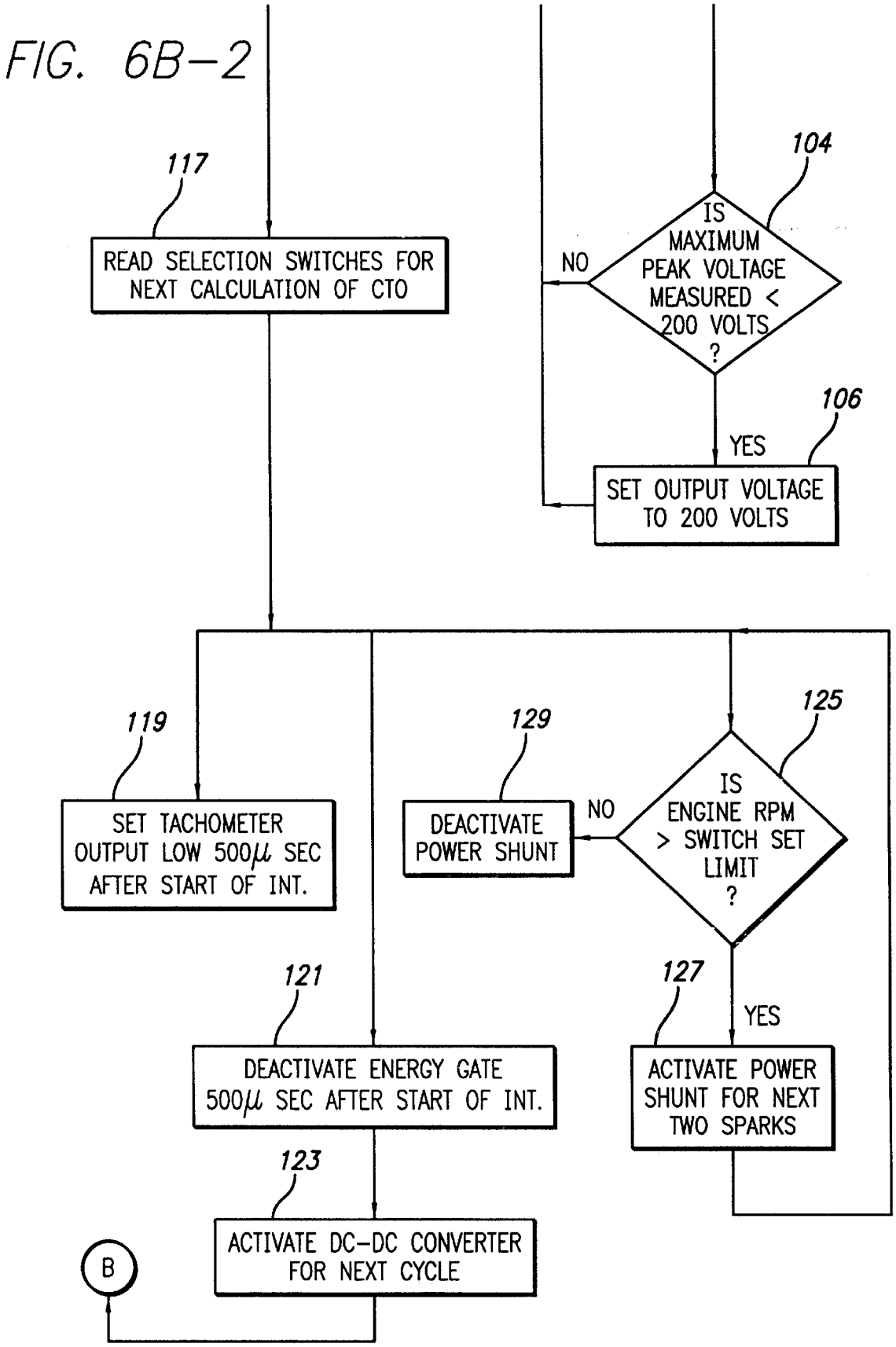
FIG. 6B-2
117
READ SELECTION SWITCHES FOR NEXT CALCULATION OF CTO
104
IS MAXIMUM PEAK VOLTAGE MEASURED < 200 VOLTS ?
NO
YES
106
SET OUTPUT VOLTAGE TO 200 VOLTS
119
SET TACHOMETER OUTPUT LOW 500μ SEC AFTER START OF INT.
129
DEACTIVATE POWER SHUNT
NO
125
IS ENGINE RPM > SWITCH SET LIMIT ?
YES
127
ACTIVATE POWER SHUNT FOR NEXT TWO SPARKS
121
DEACTIVATE ENERGY GATE 500μ SEC AFTER START OF INT.
123
ACTIVATE DC-DC CONVERTER FOR NEXT CYCLE
B

SECOND STRIKE IGNITION SYSTEM

CROSS REFERENCE TO RELATED APPLICATION

This invention is related to the invention described in my co-pending patent application entitled IGNITION ARRANGEMENT, Ser. No. 09/783,521 filed Feb. 15, 2001 and the teaching and technology thereof are incorporated herein.

BACKGROUND OF THE INVENTION

1. Field of the Invention

This invention relates to the field of ignition systems for internal combustion engines, and in particular to an improved electronic ignition system that supplements an existing ignition system, resulting in a higher quality spark ignition for more complete combustion of the fuel/air mixture in each cylinder of the engine during the compression stroke of the engine.

2. Brief Description of the Prior Art

Manufacturers of ignition systems for internal combustion engines have made many improvements over the basic breaker point type ignition systems which have been in use for decades. Many manufactures have replaced the breaker points and condenser arrangement with other types of mechanisms which detect the angular position of camshaft of the engine, and employ electronic devices to create the spark signal at the distributor for transmission to the spark plugs. However, such systems are generally replacement systems that are not supplemental to the original or existing ignition system of an internal combustion engine.

One such electronic ignition system is disclosed in U.S. Pat. No. 5,197,448 to Porreca et al. which shows and describes first and second energy sources which combine to initiate and sustain, respectively, an arc across a spark gap. The first energy source functions in a manner similar to a normal spark ignition system, and the second energy source is connected in series with the secondary winding of a step-up transformer and is only sufficient to sustain an arc, not to generate one. The electrical connections involving the generation of the second energy source is such that coupling with the primary winding is minimized.

In U.S. Pat. No. 5,638,799 to Kiess et al., a method is disclosed which employs steps of discharging a capacitor through a primary ignition coil to generate a first arc potential in a secondary ignition coil, and then induces a flyback signal from the primary to the secondary a predetermined time later. The first arc potential applied to the spark plugs is a negative going pulse, and the delayed second arc potential is an opposite polarity positive going pulse. The generation of a bipolar high voltage spark potential with negative and positive going pulses spaced apart by a predetermined time period is made possible by the use of a step-up transformer and the employment of a necessary isolation diode between the power supply (battery) and the circuitry.

Neither the Porreca et al. system nor the Kiess et al. system provides a second strike spark signal which may be combined with the spark signal generated by an existing induction ignition system to produce a composite spark signal output from the ignition coil to be distributed to the spark plugs. Moreover, neither prior art system produces a double strike pulse with both first and second spark signals of the same polarity and both generating arc potentials sufficient to ignite the fuel/air mixture in the engine cylinders.

In U.S. Pat. No. 6,123,063 there is described an ignition system which provides an augmenting spark signal overriding the spark signal provided by the basic ignition system of the engine and generating a plurality of such augmented spark signals for each original spark system.

SUMMARY OF THE INVENTION

The second strike ignition system of the present invention is, in a preferred embodiment of the present invention, a supplementary ignition system for existing induction coil ignition systems as used in internal combustion engines. It supplements the principal or first spark signal provided by the primary ignition system for the internal combustion engine. It does not alter or affect the existing first spark signal pulse. Supplementing the first spark signal with the second strike spark signal in a predetermined time sequence results in a longer duration of spark from the spark plug for each cycle of the engine and higher quality double strike spark during the compression stroke of the engine. The increased spark energy improves performance, improves gas mileage, increases horse power, reduces misfires, and decreases harmful or polluting emissions.

In other embodiments of the present invention, a second strike ignition system according to the principles of the present invention may be incorporated into the main ignition system of the engine to provide an automatic operation of the second strike therein.

In the above mentioned proffered embodiment wherein the invention herein is incorporated in an supplementary ignition system on an internal combustion engine, the main modular unit for the second strike ignition system is made small enough to be easily mounted close to the existing ignition system. Removal of mounting screws or nuts at the coil and the attachment of two wires to the exposed terminals of the coil, and another for a ground connection, complete the installation procedure. The main module is approximately 4.0"×6.0"×3.0" and may be fastened to either the distributor housing or the ignition coil, or at other desired locations.

Manufactured as a supplemental ignition system, the second strike ignition system can be removed at any time with immediate reversal of the engine to the original equipment and its performance.

The second strike ignition system is preferably modular and includes a control board, a DC to DC converter, a housing, and a group of selection switches. The DC to DC converter and the control board lie within the housing. The selection switches may be mounted on the housing or, optionally, external thereto. The DC to DC converter is mounted directly to a base plate of the housing, and holes in one end plate of the housing provide access to external switches. Input power, ground, a tachometer drive signal, a control line to an on/off switch, and the connection to the negative terminal of the primary ignition signal enter through grommets at the other end plate. The base plate also serves as a grounding and heat dispersion surface.

The second strike ignition system interfaces with the engine via three wires which connect with the negative side of the ignition coil, positive battery voltage, and battery return (chassis ground).

The second strike ignition system electronics senses activation of the primary ignition spark. At the optimum time following the sensing of the primary induction spark, dependent on the engine's characteristics, the second strike ignition system produces a supplementary induction spark signal in the primary of the ignition coil. The polarity of the two spark signals are the same and are integrated to produce two successive spark signals which cause the generation of two separate sparks at the spark plug at each cylinder during each cycle thereof which thus increases the spark energy delivered to the spark plug during each compression stroke.

When the second strike ignition system is configured as a supplemental ignition system, it monitors the first spark from the primary ignition system and provides a source of energy for a second spark that follows the primary ignition spark a predetermined time after the start of the first spark signal. The second strike ignition system works with all internal combustion engines having an induction ignition system, a distributor, and a single coil. As will be shown in the accompanying drawings and detailed description herein, the invention operates on a basic principle that impinging a delayed rising current in the opposite direction as the current created by the primary induction system results in output voltages and currents of the same polarity, the polarity that is favorable to the combustion process.

While the invention operates on the assumption that the primary ignition system sends a measurable signal to the second strike ignition system with the correct timing, the second strike ignition system reads the prime spark signal even if there is not sufficient energy to initiate the combustion of the fuel/air mixture in the cylinder. By sensing a low-level primary spark signal, the second strike ignition system will initiate the combustion of the fuel/air mixture with the second strike spark signal.

BRIEF DESCRIPTION OF THE DRAWING

Further objects and advantages and a better understanding of the present invention may be had by reference to the following detailed description taken in conjunction with the accompanying drawings in which.

DETAILED DESCRIPTION OF THE PREFERRED EMBODIMENTS

Figure 1:
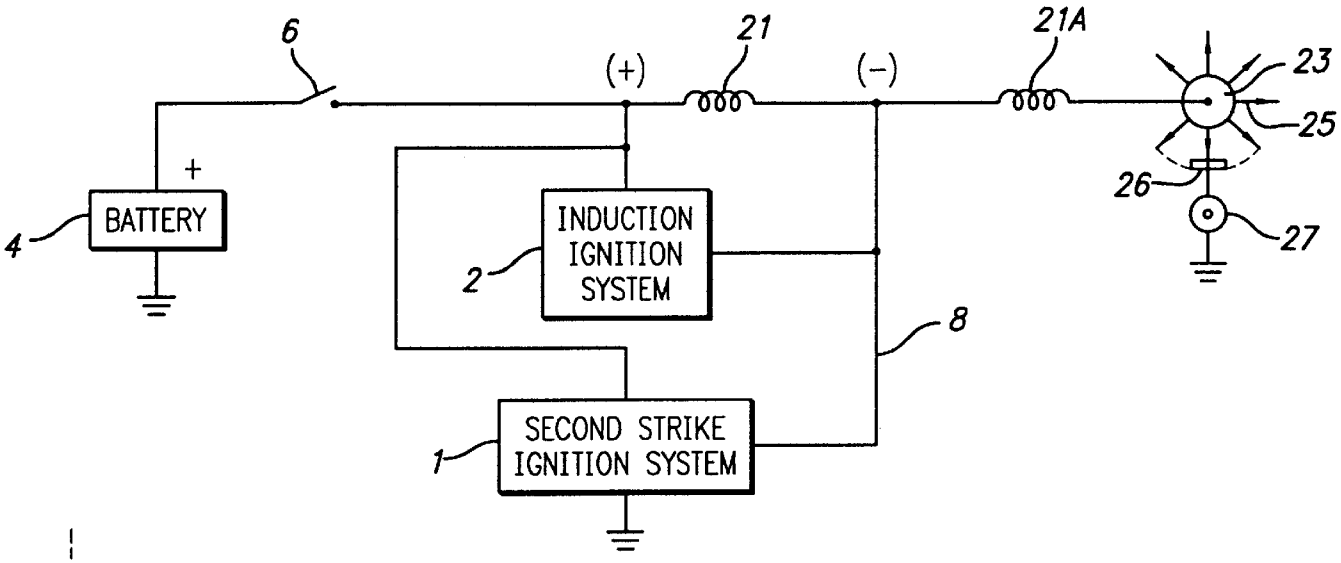
FIG. 1 is a simplified schematic diagram showing the functional placement of the second strike ignition system as it would be connected to an existing induction ignition system arrangement.

FIG. 1 shows a second strike ignition system 1 connected to an existing induction ignition system 2 associated with an internal combustion engine. The existing induction ignition system 2 receives timing information from the camshaft or crankshaft of the engine (not shown) and controls the current in the ignition coil primary winding 21 for generation of a primary spark signal. The induction ignition system 2 may be implemented by a breaker point and capacitor arrangement, or it may be implemented by an electronic ignition system arrangement. The power source for the system is supplied by a battery 4 through an ignition switch 6, as is commonly known. By forcing the negative end of the ignition coil primary winding 21 to ground and then releasing that connection, a high voltage spark potential is induced in the ignition coil secondary winding 21A of the ignition coil due to the collapsing magnetic field of the ignition coil primary 21. The high voltage spark potential from the secondary winding 21A is routed to a distributor 23 which has a rotor 25 transferring the spark potential sequentially to distributor cap contacts 26 and onto the respective spark plugs of the internal combustion engine, represented in FIG. 1 as spark plug 27. For clarity, only one of the plurality of distributor cap contacts and one of the plurality of spark plugs are shown schematically in FIG. 1.

From FIG. 1, it can be observed that the second strike ignition system, according to the present invention, is a supplemental ignition system 1 which is connectable to the existing ignition system 2 by connecting only three wires: (1) to a source of battery voltage (through ignition switch 6), (2) a battery return or chassis ground, and (3) the negative side of the ignition coil primary 21. The connection of the second strike ignition system to the negative side of the ignition coil primary 21 is made by way of a single wire 8 as shown in FIG. 1, which serves to both sense the occurrence of the primary or first spark signal at the negative terminal of primary 21, and, after a prescribed delay time, apply a second spark signal to the negative terminal of the ignition coil primary 21, resulting in a sequential first and second spark signal causing a corresponding first and second spark potential signal applied to the distributor 23 via the secondary winding 21A.

Figure 2:
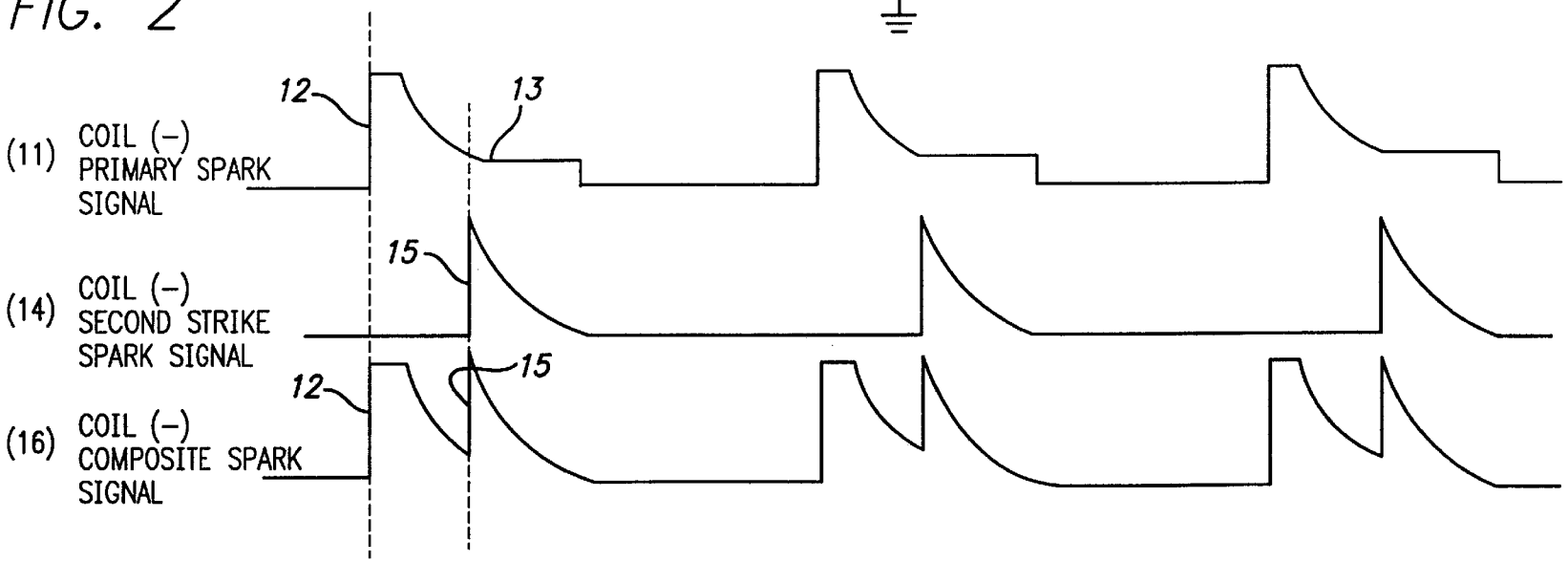
FIG. 2 shows three basic waveforms indicating the first strike signal, theoretical second strike signal, and composite strike signal.

In the waveform chart of FIG. 2, it will be observed that the signal at the negative terminal of primary winding 21 is as shown as waveform for the primary or first spark signal 11 having a sharp rising voltage edge 12 and a slowly decreasing or falling voltage edge 13. Thus, the voltage of the primary or first spark signal is variable during at least a portion of the duration thereof. This waveform is well-known to a person skilled in the art, and is typical of existing induction ignition systems for internal combustion engines. In this connection, it is to be understood that the creation of the primary spark signal 11, and the components of the system which generate the primary or first spark signal 11 are completely unaltered or affected by the incorporation of the second strike ignition system as a supplementary spark energy signal generator.

Waveform 14 indicates a theoretical second strike spark signal or ignition signal having a sharp rising edge 15 which is also applied to the negative terminal of primary 21, and, since the existing ignition system 2 has already generated the primary spark signal 11, the second strike spark ignition signal 14, is provided sequentially to the first spark signal 11. As a result of this additive process, the spark signal 16 comprised of the first spark signal 11 and second spark signal 14 now has two sharp, spaced apart, rising edges 12 and 15. As is known, due to the primary-to-secondary induction coupling, a sharp rising edge 12 or 15 at the negative terminal of the primary winding 21, relative to the low DC voltage of the battery at the positive terminal of primary winding 21, a high tension voltage is created in the secondary 21A of the ignition coil having the same waveform and timing as that occurring in the primary winding 21. Accordingly, during the time the rotor 25 is positioned adjacent each distributor cap contacts 26, two high tension spark potential pulses are transmitted through the spark plug wires to the spark plugs 27.

As will be explained in detail hereinafter, the time interval between the leading edge 12 of the primary spark signal 11 and the leading edge 15 of the second strike spark signal 14 is variable, controlled by the second strike ignition system, and dependent upon physical and operational aspects of the particular engine on which the second strike ignition system is installed. Further, the time 13A at which the second strike spark signal 14 is initiated is, in preferred embodiments of the present invention, selected at a the time that the first spark signal 11 has decreased to a value less than that required to sustain a spark at the spark plugs 27. Further, the time indicated at 12 and the time indicated at 15 are, in preferred embodiments of the present invention, both during the compression stroke of the piston in each cylinder of the engine.

Figures 3, 4:
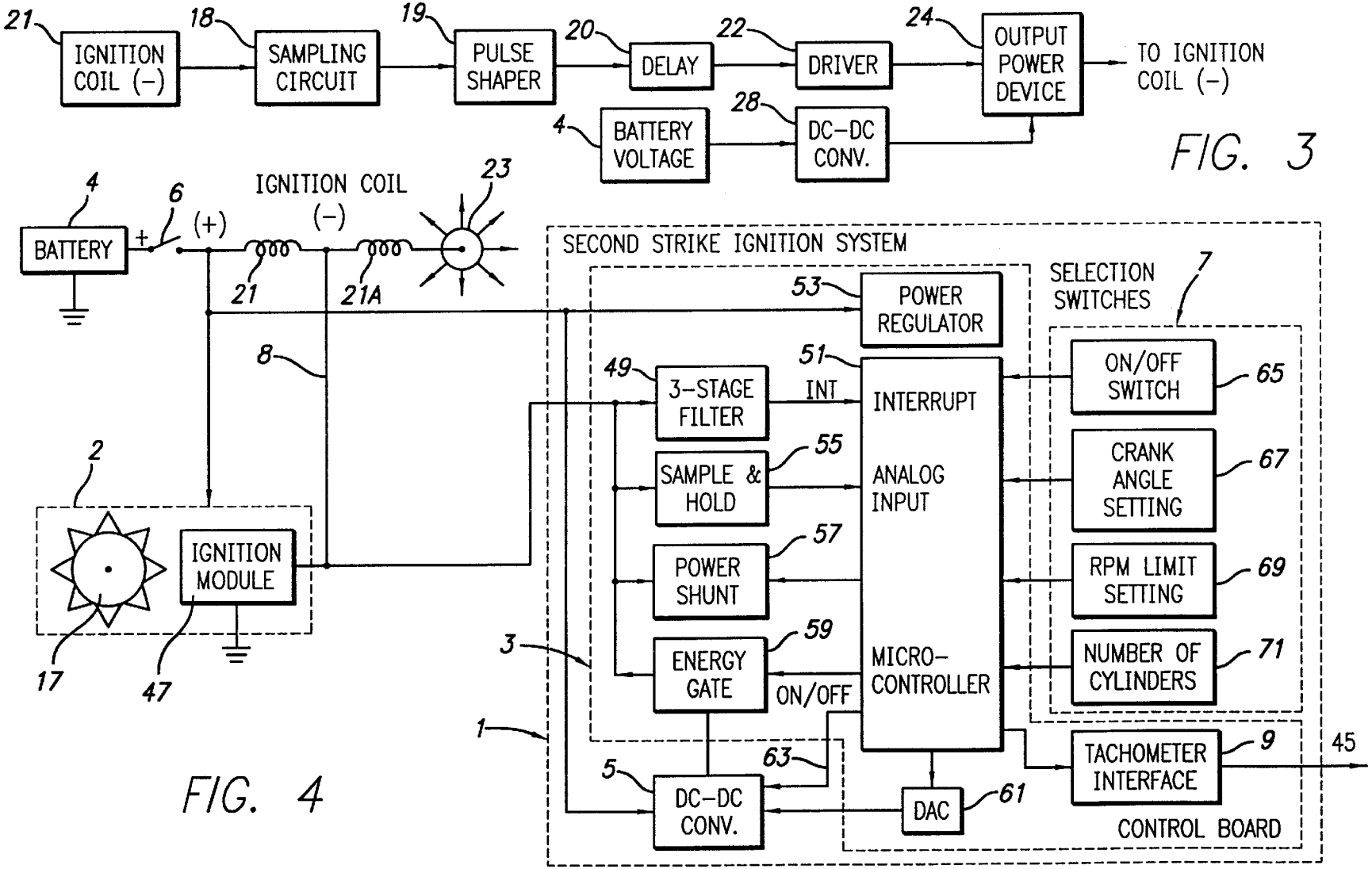
FIG. 3 is a conceptual block diagram depicting major functional blocks for carrying out the invention which could be implemented by discrete or integrated circuit components.
FIG. 4 is a detailed block diagram depicting the functional blocks for implementing the invention according to a preferred embodiment of the invention.

In FIG. 3, a conceptual block diagram is shown to illustrate the theory and principles underlying the implementation of the present invention.

As FIG. 3 indicates, the input to the second strike ignition system 1 is sensed at the negative terminal of the ignition coil primary 21, and the output of the system is applied to the negative terminal of the ignition coil primary 21 via the single connection wire 8. The output of the second strike ignition system 1 applied to the ignition coil primary 21 occurs at a time delayed from the time the second strike ignition system 1 senses the signal at the negative terminal of the primary winding 21.

The primary or first spark signal 11 (FIG. 2) is applied to a sampling circuit 18 of the second strike ignition system 1, as well as to the distributor 23 (FIG. 1) and thus serves to detect the timing of the first spark signal 11, and, together with the pulse shaper 19 receiving the output of sampling circuit 18, produces a low level pulse representing the existence of the primary or first spark signal 11. This low level pulse is then provided to a delay circuit 20 which, after a prescribed delay time, enables a driver 22 to activate an output power device 24. Output power device 24 is in preferred embodiments of the present invention an electronic gate which, when enabled, passes the output voltage from a DC—DC converter 28 onto the negative terminal of the ignition coil primary 21 through wire 8. DC—DC converter 28 converts the low level battery voltage input, from battery 4, to a higher DC voltage available at its output. While the battery voltage is typically 12 volts, the DC output available from the DC—DC converter 28 will, in preferred embodiments of the present invention, be in the range of 440 volts, i.e., a voltage level which matches the peak voltage of the primary or first spark signal 11 shown at 11 A in FIG. 2. The amount of delay introduced by delay circuit 20 in FIG. 3 is determinative of the temporal spacing between the leading edges 12 and 15, respectively, of the primary or first spark signal 11 and the second strike spark signal 14 shown in FIG. 2.

Figure 5:
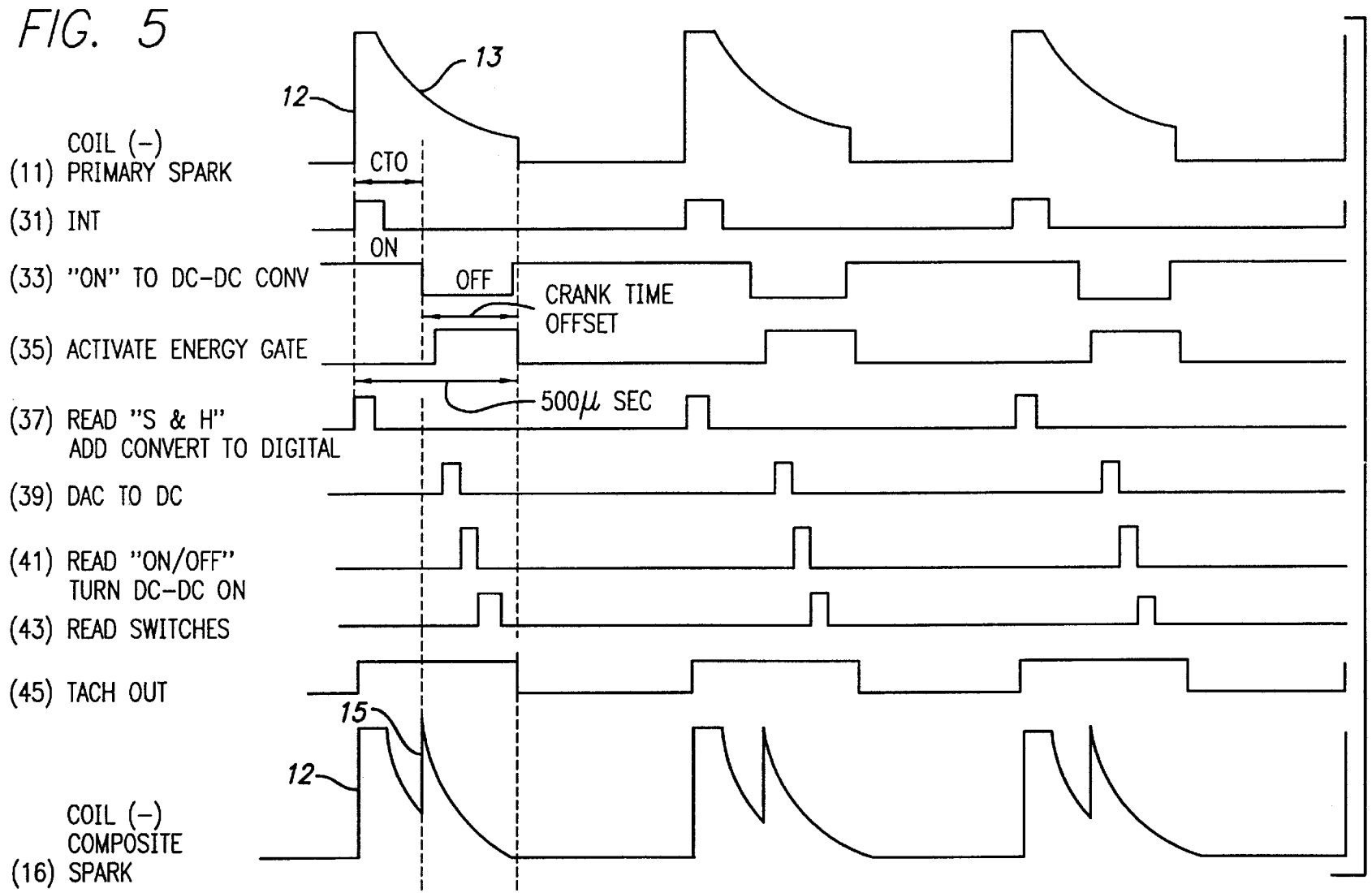
FIG. 5 is a set of waveforms to assist in the operation of the FIG. 4 embodiment.

The following description applies to the preferred embodiment of the invention shown in FIG. 4 which is explained by reference to a corresponding set of waveforms shown in FIG. 5. The wave forms shown in FIG. 5 are, just as in FIG. 2, the time-voltage wave forms for the signals of the present system. The methodology involved is more readily appreciated by reference to the continuous flow chart spanning FIGS. 6A and 6B.

In FIG. 4, the second strike ignition system 1 is shown to include a control board 3, a DC—DC converter 5, and a set of selection switches 7. Structurally, the control board 3 and DC—DC converter 5 are contained within a module housing (not shown), and a cable harness is connected between such housing and the group of selection switches 7.

Each "switch" block in the set of selection switches 7 may be a single switch or multiple switches, depending upon design decisions and need. In the description to follow, each switch block 65, 67, 69, and 71 will be referred to in the singular for convenience, even though any "switch" block may contain multiple switching elements and/or contacts.

The existing induction ignition system 2 is shown in FIG. 4 to include a rotary member 17 which is fixed to the camshaft of the distributor (not shown) and rotates therewith to couple or induce camshaft position information to the ignition module 47, preferably, but not limited to, an electronic ignition module arrangement such as that shown and described in the aforementioned co-pending application entitled "IGNITION ARRANGEMENT".

The control board 3 comprises a microcontroller 51, a power regulator 53, a three-stage filtering circuit 49, a sample and hold circuit 55, a power shunt 57, an energy gate 59, a tachometer interface 9, and a digital-to-analog converter (DAC) 61.

The DC—DC converter 5 converts, on command from the control board 3, the DC voltage provided by the engine's battery/alternator system, through ignition switch 6, to a higher voltage which can be used for generating a second spark signal after generation of a primary or first spark signal by the existing ignition system 2.

With the selection switches 7, the user controls operational modes of the second strike ignition system 1. The switches 7 include an on/off switch 65 which signals the microcontroller 51 when to execute the second strike function. The switch set 7 also includes a crank angle setting switch 67, an RPM limit setting switch 69 to set the engine revolution limit that the user does not want to exceed, and a switch 71 which sets the number of engine cylinders.

When the ignition switch 6 is rotated to the "ON" position, the microcontroller 51 senses the power-up of the system from power regulator 53, and initializes all key variables of the firmware. The key variables initiated are those parameters derived by the microcontroller's firmware that change with dynamic operating conditions, as will be explained. Initialization ensures that the firmware's derivations and control signals result from a consistent starting point.

The primary or first spark signal 11 generated at the negative end of the primary winding 21 by the primary ignition system 2 is the master timing reference. As the starter rotates the engine crankshaft (not shown), the primary ignition system 2 sequentially generates and releases energy to the spark plugs.

It is this energy release at the spark plugs that creates the sparks, ignites the fuel/air mixture in the cylinders, and causes the engine to rotate without starter drive assistance. During this sequence, the induction ignition system 2 creates the primary spark signal 11 as shown in FIG. 5 as waveform 11.

The interface wire 8 carries the primary spark signal 11 to the control board 3 contained within the second strike ignition system housing (not shown). On the control board 3, a three-stage filter 49 filters the sensed primary spark signal 11 to produce a stable low level signal suitable for input to microcontroller 51. Filter 49 outputs the filtered signal, shown in FIG. 5 as INT waveform 31, to the external interrupt input on the microcontroller 51. The INT waveform 31 is derivable directly from the primary or first spark signal 11 insofar as timing is concerned. The microcontroller 51 reacts to the external interrupt INT 31 input and performs the functions as defined by the firmware, as follows.

Good filtering of the primary spark signal 11 by the three-stage filter 49 is desired to provide proper performance of the second strike ignition system. Excessive voltage levels, voltage ringing, and negative voltage swing could create malfunctions. The three stages of the analog filtering block 49 eliminate these sources of malfunction. Consequently, the interrupt signal INT 31 seen by the microcontroller 51 on its interrupt input is pure.

In addition to the filtering by filter 49, a software algorithm additionally filters the primary spark signal 11. The algorithm interprets the first interrupt signal as true. Sources of false signals occur as a result of the primary spark, and therefore occur after the first interrupt signal. The microcontroller 51 ignores interrupt signals that occur within, for example, 500 $\mu$ seconds of the first interrupt signal. A true interrupt never occurs sooner than, for example, 1,000 $\mu$sec after the prior true interrupt signal. All false signals occur within 100 $\mu$sec of the true interrupt. By ignoring secondary interrupts, the software algorithm furnishes additional filtering.

On the rising edge 31A of the external interrupt signal, INT 31, the microcontroller 51 starts the processing cycle. The microcontroller 51 first calculates the period, Pi, between rising edges 31A of successive INT 31 inputs. Pi is used later in the processing cycle for determining engine RPM, the crank time offset (CTO), and for making decisions regarding the RPM limit.

The microcontroller 51 then sets the tachometer output 45, through tachometer interface 9, to a high level. This can be done anywhere in the processing cycle, since any near square wave is acceptable to most modern tachometers. It is a timing convenience to make this happen in synchronism with INT 31.

From the calculated RPM, the microcontroller 51 ascertains if the engine is running or starting. If the engine is starting, the DC—DC converter 5 is turned off so as not to be a drain on the battery. The DC—DC converter 5 takes considerable current from the engine battery charging system. Although the second spark from the second strike ignition system would help hard-starting engines, the current drain would inhibit starting torque. It is an object of the present invention that the second strike ignition system does not, in any way, impede the performance of the primary ignition system. Therefore, the operational sequence as described below occurs only after the engine has started.

In FIG. 5, it is assumed that the engine is running, and therefore the starting level for the DC—DC converter 5 input is high (see waveform 33), indicating that the DC—DC converter 5 is in a state in which the battery voltage input is being converted to a higher voltage level.

The microcontroller 51 calculates a timing delay from the rising edge 31A of INT 31 equal to crank-time-offset (CTO), and, after such delay from the rising edge 31A of INT 31, sets input signal 33 to the DC—DC converter 5 to a low state over line 63, turning the DC—DC converter 5 off. The on/off signal on line 63 is controlled by the microcontroller 51 that tells the DC—DC converter to start and stop charging. The signal is used to give the DC—DC converter the maximum time to charge and to concurrently ensure that the converter is not charging during the fire/discharge time.

The microcontroller 51, during available time in the processing cycle, calculates the CTO for the upcoming processing cycle. The CTO is determined by the user selected crank angle offset (CAO) switch setting as set by crank angle setting switch 67, as well as the current RPM of the engine. As will be explained subsequently, the microcontroller 51 receives information from the selection switches 7 to know the user selected CAO from switch 67, and the number of engine cylinders from switch 71. With the latest calculated Pi, the number of cylinders, and the commanded CAO, the microcontroller 51 calculates the CTO. The following expression summarizes the calculations.

$$CTO=(CAO)\times(Pi)\times(\#\ cyl.)\times(1/720)$$

So as not to interfere with the efficacy of the primary spark, the minimum CTO is set at, for example, 75 $\mu$sec.

Immediately after shutting off the DC—DC converter 5, i.e. waveform 33 goes low, the microcontroller 51 activates the output energy gate 59, waveform 35. This event transfers the energy previously stored in a DC—DC converter 5 to the negative end of primary winding 21. The energy supplied by the DC—DC converter is coupled by the ignition coil primary 21 to the secondary coil 21A and on to the spark plug via the distributor 23. This provides the second strike of spark energy, represented by the theoretical waveform 14 shown in FIG. 2, and by the rising edge 15 of waveform 16, at the commanded CAO.

The microcontroller 51 keeps track of time from the rising edge 31A of INT 31, and at 500$\mu$ seconds from the rising edge 31A of INT 31, microcontroller 51 deactivates the energy gate 59. This discontinues the transfer of energy from the DC—DC converter 5 to the ignition coil primary 21 and to the spark plugs, and simultaneously sets the tachometer output 45 low, as seen by reference to waveform 45 in FIG. 5. With such a timing sequence, the tachometer output 45 approaches a near 50% duty cycle, as indicated.

Immediately following the deactivation of the energy gate 59 (waveform 35), the microcontroller 51 activates the DC—DC converter 5 (waveform 33). Activation of the DC—DC converter 5 immediately following deactivation of the energy gate 59 gives maximum time for the DC—DC converter 5 to build energy for the next spark. Activation of energy gate 59 occurs only if the on/off signal on line 63 is "ON".

The microcontroller 51 then reads the analog voltage provided by the sample and hold circuit 55 at the time shown on FIG. 5 as waveform 37. The sample and hold circuit 55 charges quickly to a voltage level proportional to the peak voltage at the negative terminal of the primary winding 21 developed by the primary ignition system 2 and holds this voltage for 50 milliseconds. The microcontroller 51 converts this sampled voltage to an 8-bit digital word employing an internal analog-to-digital converter (not shown) and transfers this word to the digital-to-analog converter (DAC) 61. The voltage represented by this digital word is proportional to the peak voltage created at the negative terminal of the primary winding 21 by the primary ignition system 2. The peak voltage level is needed to ensure that the voltage created by the DC—DC converter 5 is not greater than the voltage created by the primary ignition system 2. A secondary voltage greater than the primary voltage could cause damage to the primary ignition system. The second strike ignition system is designed to work with all primary ignition systems without altering performance or reliability.

As stated, the microcontroller 51 transfers the 8-bit digital word proportional to the peak voltage at the negative terminal of primary 21 to the DAC 61. The DAC 61 sends an equivalent analog voltage to the DC—DC converter 5 with timing as shown by waveform 39 in FIG. 5. The DC—DC converter 5 sets its output voltage proportional to the analog voltage received from the DAC 61.

For example, an analog voltage of 4.0 volts at the sample and hold circuit 55 output corresponds to a peak voltage of 440 volts at the negative terminal of the primary winding 21. The microcontroller 51 converts this 4.0 volts to a digital word 1100 1100. The DAC 61 receives this digital word and converts it to an analog voltage of 4.0 volts. The analog 4.0 volt output from the DAC 61 is connected as input to the DC—DC converter 5. The DC—DC converter 5 translates this 4.0 volts to 440 volts. The 440 volts from the DC—DC converter 5 thereby equals the 440 volt peak created at the negative terminal of the primary winding 21 by the primary ignition system 2. This process ensures that the voltage provided by the DC—DC converter 5 never exceeds the peak primary voltage.

The control voltage transferred to the DC—DC converter 5 may not always be the same at the voltage as that stored by the sample and hold circuit 55. Without regard to the time of sampling, the value at the input to the sample and hold circuit 5 will not be stable. It will reflect the influence of the second strike pulse 15 as well as the primary spark pulse 12. It is, of course, desirable for the DC—DC converter 5 to receive a stable signal that reflects the voltage of only the primary spark signal 12. To accomplish this, the microcontroller 51 samples the voltage immediately after the generation of the primary spark 12 and uses that voltage value to set the control level to the DC—DC converter 5.

There is an exception to the restriction that the voltage provided by the DC—DC converter 5 never exceeds the peak primary voltage. In a preferred embodiment of the invention, the sample and hold circuit 55 samples the primary or first spark signal, and if it is less than 200 volts, the microcontroller 51 sets the secondary pulse 15 at a minimum of 200 volts. If the peak of the primary or first spark signal is greater than 200 volts, the microcontroller 51 sets the peak of the second spark signal pulse 15 at the level of the primary spark pulse 12.

Moreover, the sample and hold circuit 55 and the analog-to-digital circuit (not shown) in microcontroller 51 perform two functions. This combination of elements measures the peak voltage resulting from the primary ignition system. This peak voltage is used for setting the voltage level of the DC—DC converter 5. At higher RPM, there is not sufficient time between the rising edge of the primary ignition pulse 12 to the application of the second strike measurement. Therefore, at some predetermined RPM, the algorithm will discontinue measuring the peak voltage of the primary ignition system. For setting the voltage level of the DC—DC converter 55, the algorithm will use the greatest peak value measured. As a secondary function, the microcontroller 51 measures the peak voltage resulting from the second strike pulse 15. This is a check to ensure that the DC—DC converter 5 is not overdriving the primary ignition system. If the voltage level resulting from the second strike pulse 15 is greater than the largest peak voltage measured coming from the primary ignition system, the algorithm will appropriately decrement the voltage command to the DC—DC converter 5.

The microcontroller 51 reads four sets of switches 65, 67, 69, and 71:

1) The "ON/OFF" switch 65 which is activated when the user wants the benefit of the second strike energy, i.e. it permits the user to engage and to disengage the second strike function. This is one bit of information that is read directly into the microcontroller 51 with timing as shown by waveform 41 in FIG. 5. The RPM limit switch 69 and tachometer interface 9 functions are not affected by the ON/OFF switch 65. The settings of all other switches 67, 69, and 71 are read by microcontroller 51 with timing indicated by waveform 43 in FIG. 5.
2) The "crank-angle-offset" switch 67 is a ten position rotary switch with selections from "0" to "9". The "0" position indicates the minimum crank angle offset between the primary spark and the secondary spark. Each value "1" through "9" is two degrees of crank-angle-offset. For example, a switch setting in the "3" position will result in the second strike leading edge 15 occurring at 6 degrees of crank angle after the primary spark leading edge 12. With the switch 67 in the "9" position, the second strike will occur at a crank angle of 18 degrees after the primary spark. The microcontroller receives the switch information from switch 67 in four bits of binary coded decimal.
3) Switch 71 sets the number of engine cylinders. It is a ten position rotary switch going from "0" to "9". The meaningful positions for automobile applications are those corresponding to "4", "6", and "8". The number of positions in the switch 71 may be increased as desired to accommodate, for example, the ten cylinder engines in certain automobiles. For example, with the switch 71 set in the "6" position, the microcontroller 51 processes all information for a 6-cylinder engine. For industrial applications, however, positions "1", "2", "3", and "5" may be meaningful. The microcontroller 51 receives the number of cylinders in binary coded decimal.

Optionally, the "0" position of the number of cylinders switch 71 may advantageously be used to signify the "OFF" position for the second strike ignition system. Any position other than the "0" position will be interpreted as an "ON" position. This will reduce the number of switches, eliminating on/off switch 65, and the associated wires and I/O required.

4) RPM limit setting switch 69 which, preferably, comprise a dual switch pair. Both are ten position switches settable from "0" to "9". One switch represents the thousands digit, and the other represents the hundreds digit. For example, to set a limit for the engine at 5700 RPM, the first switch is set at "5" and the second switch is set at "7". The microcontroller 51 receives the RPM limit in binary coded decimal.

The microcontroller 51 compares the engine RPM (using the calculate Pi previously described) to the limit set by the RPM limit switch 69, and if the engine's RPM is greater than the set limit, microcontroller 51 activates the power shunt 57 to inhibit the second strike for the next two sparks. The microcontroller 51 then resumes the ignition process by deactivating the power shunt 57 and permitting the second strike processing to continue. If the engine's RPM is still greater than the RPM limit set by switch 69, the microcontroller 51 again shunts two sparks and then resumes the ignition process. This will continue until the engine's RPM is below the limit set by switch 69. When the RPM is below the limit set by switch 69, the second strike process will continue as previously described.

As shown in FIG. 5, the spark signal 16 indicates two voltage spikes at the negative terminal of the primary ignition coil 21. The voltage at 13A is a voltage of the first spark signal that is, in preferred embodiments of the present invention, less than the value needed to sustain a spark at the spark plugs. Thus, the second spark signal does not alter or effect the first spark signal during the time period that the first spark signal is generating a spark at the spark plug. Therefore, as utilized herein, it will be appreciated that the phrase "free of altering the first spark signal" and similar words describing this characteristic of the present in ivention are used for convenience to describe the this function of the present invention where in the second spark signal is initiated when the first spark signal ceases to cause a spark at the spark plug. The two voltage spikes 12, 15 are separated by a delay, described herein as crank-time-offset (CTO), corresponding to the crank-angle-offset (CAO) inputted by the user by setting the delay angle setting switch 67. The primary voltage spikes 12 created by the existing induction ignition system 2 results from the stoppage of positive primary current flowing from the plus to the minus terminal of the induction coil primary 21. The magnetic flux created by the positive primary current collapses as a result of this current stoppage, as explained. The collapsing magnetic flux crosses the windings of both the primary winding 21 and the secondary winding 21A of the ignition coil. The interaction of falling positive flux and the windings create positive voltages at the negative terminal of the primary winding 21, as well as at the output of the secondary coil 21A, as depicted in the waveform shown in FIG. 5 as primary spark signal 11. It is the high-tension voltage at the output of the secondary coil 21A that is coupled to the spark plug by the spark plug wires that generates the first spark signal and causes a spark at the spark plug for initiating the combustion of the fuel/air mixture in the cylinder.

The second strike voltage spikes 15 at the negative terminal of the primary winding 21 come from the second strike ignition system 1. The impingement of the second strike voltage spike 15 at the negative terminal of the primary winding 21 induces a rising negative current flow in the primary coil 21 from the negative terminal to the positive terminal. This rising negative current creates a rising negative magnetic flux. The rising negative flux crosses the windings of both the primary coil 21 and the secondary coil 21A of the ignition coil. The interaction of the rising negative flux with the windings of the ignition coil have the same result as the interaction of collapsing positive flux with the windings of the coil. Consequently, the voltages and currents from the output of the ignition coil created by the primary ignition pulse 11 and by the second strike spark signal pulse (shown theoretically in FIG. 2 as the second strike spark signal 14) have the same polarity, and transfer energy to the spark plugs in the favorable direction.

Figure 6A:
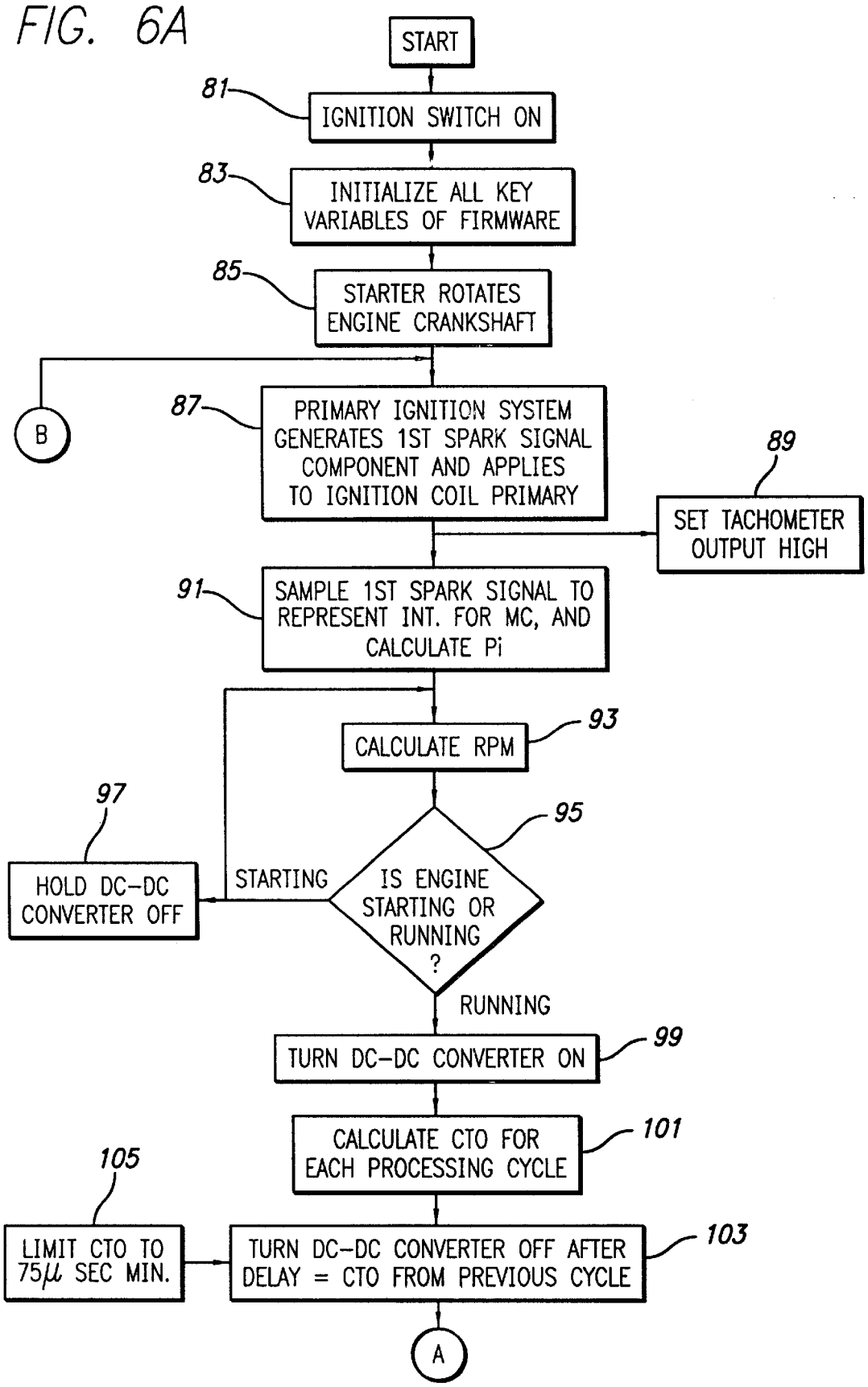
FIGS. 6A and 6B show a continuous flow diagram indicating the methodology performed by operation of the preferred embodiment of the invention shown in FIG. 4.
Figures 1, 6B:
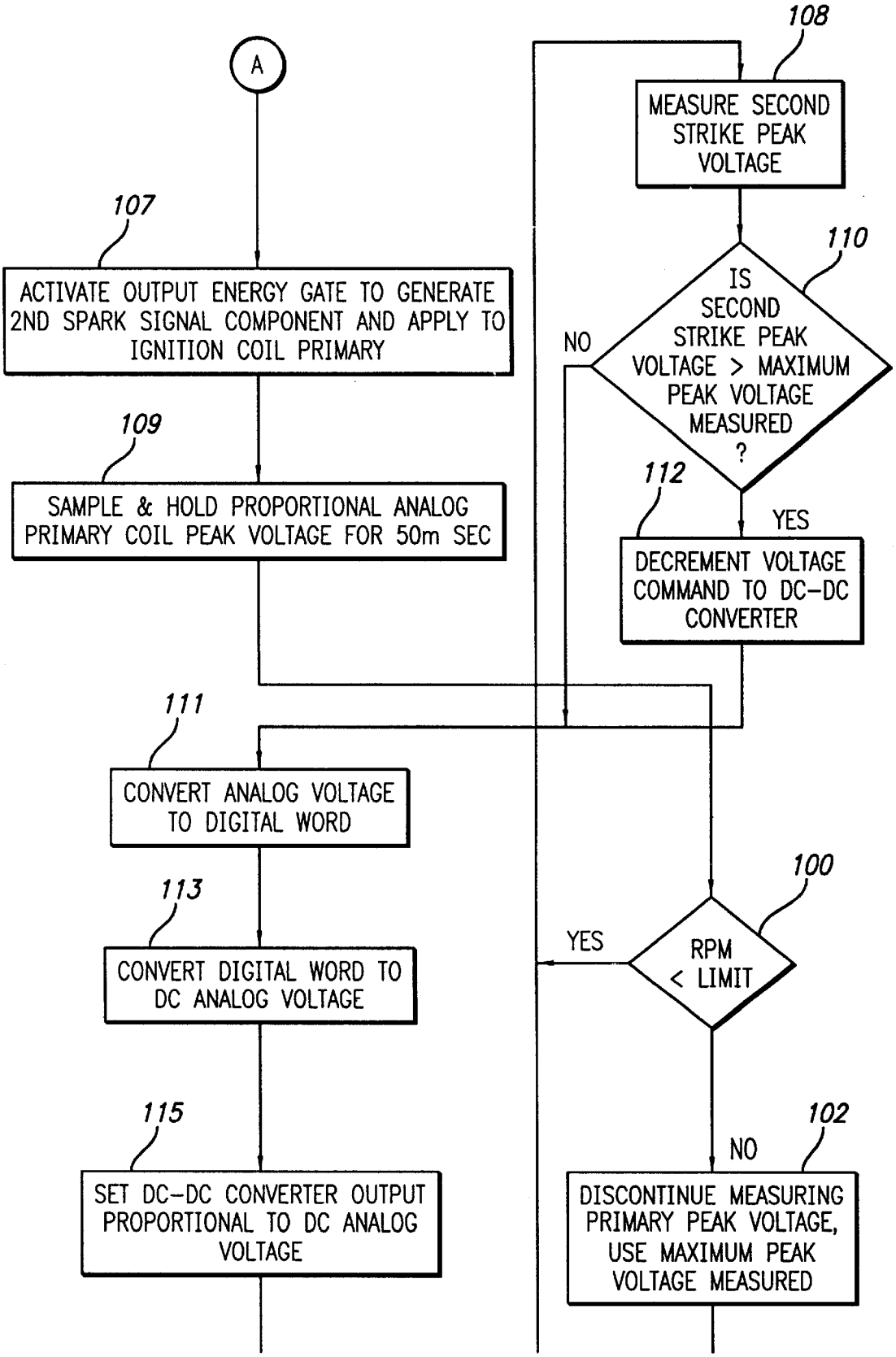

FIGS. 6A and 6B together comprise a flow chart documenting the procedural steps executed by the microcontroller 51 and the associated firmware. FIGS. 6A and B are presented as steps of a preferred method of operation which may be implemented by the specific arrangement shown in FIG. 4 or any other arrangement which follows the methodology set forth in FIGS. 6A and B.

First, with reference to FIG. 6A, the operation of the second strike ignition system starts when the ignition switch is turned on as indicated in function block 81. All key variables of the firmware are then initialized according to block 83. The starter rotates the engine crankshaft, at 85, and the primary ignition system generates a first spark signal component at 87. Simultaneously with generating the first spark signal component, the tachometer output is set high, at 89.

The first, or primary, spark signal is sampled to represent an interrupt input INT for the microcontroller 51 which calculates the period Pi between rising edges of the interrupt signal as indicated in function block 91. A tachometer output 45 is transmitted regardless of the state of the "ON/OFF" switch 65. The microcontroller 51 calculates Pi/2 and sets the tachometer output low at Pi/2 after the rising edge of INT. Consequently, the duty cycle is substantially 50%.

At 93, the RPM of the engine is calculated, and a decision block 95 determines if the engine is starting or running. If the engine is starting, a DC—DC converter is held off at function block 97, and the decision block 95 again checks the calculated RPM from block 93. After the decision block 95 determines, based upon the RPM exceeding a certain minimum value, that the engine is running, the DC—DC converter is turned on at 99. The CTO for each processing cycle is then calculated in block 101, and the DC—DC converter is turned off after a delay equal to CTO from the previous cycle as indicated in block 103. Block 105 merely indicates that any calculated CTO must exceed 75 $\mu$sec.

Upon turning the DC—DC converter off in block 103, an output energy gate is activated to output the second spark signal component as indicated in function block 107.

In the meantime, a sample and hold circuit samples the primary spark signal and holds an analog equivalent of the primary coil peak voltage for 50 milliseconds in function block 109. Under normal operating conditions, this sampled analog value is then converted to a digital word in function block 111, and then reconverted back to a DC analog voltage from the digital word in block 113 in a condition to be applied to the DC—DC converter and represents a limit for the output of the DC—DC converter to, typically, be no greater than the peak voltage of the primary spark signal as indicated in block 115. However, two tests are made of ignition system prior to converting the analog voltage to a digital word in block 111.

Test checks of the RPM of the engine determines if the RPM is greater than a predetermined threshold limit, the threshold value determined based on the type of engine and its ignition system parameters. This test is made in function block 100. If the RPM is less than the threshold limit, there is sufficient time for the microcontroller 51 to sample and convert the peak primary voltage sample to an equivalent digital word and to perform all other functions that are needed at the time. The conversion in block 111 is thus enabled, subject to a condition of the second strike pulse, to be described below. However, if the RPM is greater than the threshold limit, there is insufficient time to sample, convert, and perform other functions, and the microcontroller 51 will discontinue measuring the primary peak voltage and use the maximum peak voltage detected for the primary induction system, according to block 102.

In decision block 104, if the RPM is greater than the predetermined threshold limit as determined in block 100, the maximum peak voltage measured is tested to determine if it is less than 200 volts, a voltage level above which is sufficient to cause combustion in all but very high performance exotic fueled engines. If the maximum peak voltage measured is less than 200 volts, the voltage sent to the DC—DC converter 5 is set to 200 volts in block 106. If 200 volts or greater, no change in the maximum peak voltage measured is made.

In function block 108, a separate check is made on the second strike peak voltage, after a delay time from the release of energy from the DC—DC converter. In block 110, a determination is made as to whether or not the second strike peak voltage is too great, i.e., if it exceeds the maximum peak voltage detected for the primary induction system. If "yes", the voltage command to the DC—DC converter 5 is decremented according to block 112, thus ensuring that the DC—DC converter 5 output voltage is not overdriving the primary ignition system. On the other hand, if the second strike peak voltage is not excessive, the voltage command to the DC—DC converter 5 is not altered.

After generation of the second spark signal component in function block 107, the settings of a group of selection switches are read for the purposes of calculating the next CTO, and this is indicated in functional block 117. Upon reading the selection switches in block 117, the tachometer output is set low 500 $\mu$ seconds after the leading edge of the interrupt signal as noted in block 119. At the same time, block 121 indicates that the energy gate is deactivated, also 500 $\mu$ seconds after start of the interrupt. The DC—DC converter is then activated to begin accumulating energy for use in the next cycle of operation as shown in function block 123, and the procedure starts again upon receipt of the next primary spark signal 11, following the event line B from Block 123 back to block 87.

After the CTO for the next cycle is calculated in block 117, a decision in block 125 is made as to whether or not the engine RPM is greater than a switch set limit set by the user. If the engine RPM does not exceed the set limit, the power shunt is deactivated at block 129. On the other hand, if the engine RPM is greater than the switch set limit, the power shunt is activated for the next two sparks in block 127, and this process continues until the engine RPM is equal to or less than the switch set limit.

The following summarizes the features of the second strike ignition system.

The second strike ignition system does not alter the primary or first spark characteristics while the first spark has sufficient value to cause a spark at the spark plug. It follows the basic timing of the primary ignition system. The timing established by the OEM or the end user remains unaltered by the second strike ignition system.

The second strike ignition system essentially doubles the energy available for creating the sparking at the spark plug during, preferably, the compression stroke of the engine cycle. This means that even with adverse operating conditions, such as poor fuel, fouled plugs, bad timing, worn engine parts, and fuel/air turbulence, there is sufficient energy for satisfactory sparks at the spark plug to cause combustion of the fuel/air mixture which the primary or first spark signal did not cause to be burned.

As RPM increases, the energy in a typical induction ignition drops off considerably. This is due to the limited time between sparks to charge the primary of the ignition coil. The second strike ignition system charges much faster than the primary induction ignition system. Therefore, even at higher RPM the second strike ignition system continues to supply high energy levels for the spark. At higher RPM, use of the second strike ignition system results in fewer misfires and much better performance.

The adaptive voltage feature of the present invention tailors the output voltage of the second strike ignition system to the peak primary coil (–) voltage generated by the primary ignition system. This ensures that the second strike ignition system will not damage the primary ignition system by overdriving the primary coil with excessive high voltage.

The second strike ignition system permits the user to select CAO. The user, through experimentation, can determine the CAO that is optimum for his fuel and driving profile. Optimum performance means more output power, less fuel, and less pollution.

The second strike ignition system permits user setting of the RPM limit. Some users may want to protect their engines from excessive RPM and associated potential damage. The second strike ignition system allows the user to set this limit.

While only certain embodiments have been set forth, alternative embodiments and various modifications will be apparent from the above description to those skilled in the art.

For example, it is to be understood that the principles set forth herein for implementing an ignition system that is supplemental to an existing ignition system apply equally well to a total replacement ignition system in which both the primary and secondary spark signals are developed. In such a replacement system, a microcontroller would receive timing information directly from the camshaft, and generate a similar two sequential spark signals in much the same way and with much the same functional components as with the supplemental system. One difference would be that there would be no need for sensing and filtering the first strike spark signal since that timing would already be known to the microcontroller which originated the first strike spark signal. All other second strike ignition system components would remain and operate in the same manner as described for the embodiment of the invention in which only a supplemental ignition system is involved.

These and other alternatives are considered equivalents and within the spirit and scope of the present invention.

What is claimed is:

1. A method of creating a second spark signal subsequent to the occurrence of a first spark signal, said first spark signal generated from a main induction ignition system, said first spark signal having a predetermined polarity, and a first predetermined duration determined by the main induction ignition system and said first spark signal having a predetermined voltage variable during at least a portion of the predetermined duration thereof, said method comprising:

sensing the start of said first spark signal and producing an enabling signal delayed from said start of said first spark signal;

generating said second spark signal a predetermined time period subsequent to said duration of said first spark signal and responsive to said enabling signal, and said second spark signal substantially free of alteration of said first spark signal.

2. The method as claimed in claim 1, wherein:

said second spark signal is of the same polarity as said first spark signal.

3. The method as claimed in claim 1, wherein generating said second spark signal comprises:

determining the peak voltage of the first spark signal; and limiting the peak voltage of said second spark signal to an amplitude no greater than that of the first spark signal.

4. The method as claimed in claim 1, employed to generate a spark at a spark plug in an internal combustion engine, and wherein generating said second spark signal comprises:

determining the magnitude of said voltage of said first spark signal;

comparing the determined magnitude of said voltage of said first spark signal with a predetermined threshold voltage; and generating said second spark signal having a peak amplitude sufficient to generate a spark at said spark plug for the condition of determining said voltage of said first spark signal at a magnitude less than said predetermined threshold.

5. The method as claimed in claim 1, applied to an internal combustion engine, comprising:

calculating a crank-time-offset from a relationship between a user selected crank-angle-offset, the number of cylinders in the engine, and the instantaneous RPM of the engine; and generation of said second spark signal initiated a predetermined time delay subsequent to said start of said first spark signal, and said generation of said second spark signal is substantially equal to the calculated crank-time-offset.

6. The method as claimed in claim 1, applied to an internal combustion engine having a main induction system, the main induction ignition system having an induction ignition coil primary and an induction ignition coil secondary, said method comprising:

calculating the RPM of the internal combustion engine from the timing of a plurality of said sensed first spark signals;

comparing said calculated RPM with a user selected engine RPM maximum value; and activating a power shunt to shunt the primary ignition coil to ground potential for a predetermined number of subsequent spark signals for the condition of said calculated RPM exceeding said user selected engine RPM maximum value;

continuing the comparing process until the engine RPM is no greater than the user selected engine RPM maximum value; and, deactivating said power shunt for the condition of the engine RPM having a value no greater than the value of the user selected engine RPM maximum value.

7. A method of generating a plurality of second spark signals from an ignition coil in an induction ignition system, the ignition coil having a primary coil winding and a secondary coil winding, and wherein a plurality of first spark signals is produced in the ignition coil primary winding by interrupting current flowing in one direction through the ignition coil primary coil winding, and each of said plurality of first spark signals having a predetermined polarity and a first predetermined duration determined by the main induction ignition system and each of said first spark signals having a predetermined voltage variable during at least a portion of the predetermined duration thereof, and only one of said plurality of second strike signals following each of said plurality of first strike signals, comprising the steps of:

reversing the direction of current flow in the ignition coil primary winding a predetermined time period subsequent to the start of said first spark signal, thereby producing said only one second spark signal following each first spark signal in the ignition coil primary winding.

8. The method as claimed in claim 7, wherein:

said first spark signal and second spark signal are of the same polarity.

9. The method as claimed in claim 7, comprising:

determining the peak voltage of each of said plurality of first spark signals; and limiting the peak voltage of each of said plurality of second spark signals to an amplitude no greater than that of said first spark signal preceding each of said second spark signal.

10. The method as claimed in claim 7, employed to generate a spark at a spark plug in an internal combustion engine, and wherein generating said plurality of second spark signal comprises:

determining the magnitude of said voltage each of said plurality of first spark signals;

comparing the determined magnitude of said voltage of each of said plurality of first spark signals with the magnitude of a predetermined threshold voltage; and generating said one of said plurality of second spark signals having an amplitude sufficient to generate a spark at the spark plug for the condition of the magnitude of said voltage of said first spark signal preceding each of said plurality of second spark signals less than said predetermined threshold.

11. The method as claimed in claim 7, applied to an internal combustion engine, comprising:

calculating a crank-time-offset from a relationship between a user selected crank-angle-offset, the number of cylinders in the engine, and the instantaneous RPM of the engine; and generation of said one of each of said plurality of second spark signals initiated a predetermined time delay subsequent to said start of each one of said plurality of said first spark signals, and said generation of each of said plurality of second spark signals is substantially equal to the calculated crank-time-offset.

12. The method as claimed in claim 7, applied to an internal combustion engine having a main induction ignition system, the main induction system having an induction coil primary and an induction coil secondary, and said plurality of second strike signals is generated throughout the RPM range of the engine, the method comprising:

calculating the RPM of the engine from the timing of each of said plurality of said first spark signals;

comparing said calculated RPM with a user selected engine RPM maximum value; and activating a power shunt to shunt the primary ignition coil to ground potential for a predetermined number of subsequent spark signals for the condition of said calculated RPM exceeding said user selected engine RPM maximum value, and continuing the comparing process until the condition of the engine RPM having a value no greater than the user selected engine RPM maximum value;

deactivating said power shunt for said condition of the engine RPM having a value no greater than the value of the user selected engine RPM maximum value.

13. A second strike ignition system for creating a plurality of second spark signals, one of said plurality of second strike signals subsequent to the occurrence of one of a plurality of first spark signals, each of said first spark signals generated from a main induction ignition system, each of said first spark signals having a predetermined polarity and a first predetermined duration determined by the main induction ignition system and each of said first spark signals having a predetermined voltage variable during at least a portion of the predetermined duration thereof, comprising, in combination:

a sensor sensing each of said first spark signals and producing one enabling signal delayed from the start of each of said first spark signals;

a pulse generating arrangement for generating a single second spark signal for the occurrence of each of said first spark signals at a predetermined time subsequent to the start of each of said first spark signals and responsive to said enabling signal; and, each of said plurality of second spark signals free of alteration of said first spark signal.

14. The second strike ignition system as claimed in claim 13, wherein:

each of said plurality of second spark signals has the same polarity as the preceding first spark signal.

15. The second strike ignition system as claimed in claim 13, further comprising:

a peak detector for determining the peak voltage of each of said plurality of first spark signals; and a limiter limiting the peak voltage of the single second spark signals following each one of said first spark signals to an amplitude no greater than that of said one of said first spark signals preceding each of said second spark signals.

16. The second strike ignition system as claimed in claim 13, employed to generate a spark at a spark plug in an internal combustion engine, comprising:

a peak detector for determining the peak voltage of each of said plurality of first spark signals; and a comparator for comparing the magnitude of the peak voltage of each of said plurality of first spark signals with the magnitude of a predetermined threshold voltage; and said pulse generating arrangement for generating said plurality of second spark signals, each of said plurality of second spark signals having an amplitude sufficient to generate a spark at the spark plug for the condition of the magnitude of each of said plurality of first spark signals less than said predetermined threshold.

17. The second strike ignition system as claimed in claim 13, applied to an internal combustion engine, comprising:

a processor calculating a crank-time-offset from a relationship between a user selected crank-angle-offset, the number of cylinders in the engine, and the instantaneous RPM of the engine; and wherein said pulse generating arrangement for initiating the generation of one of said plurality of second spark signals after a time delay equal to the calculated crank-time-offset from the start of the preceding first spark signal.

18. The second strike ignition system as claimed in claim 13, applied to an internal combustion engine, the main induction ignition system having an induction primary ignition coil and an induction secondary ignition coil, comprising:

a processor for calculating RPM of the engine from the timing of each of said sensed plurality of first spark signals;

a comparator comparing said calculated RPM with a user selected engine RPM maximum value and generating a control signal in response thereto, said control signal having a first value for the condition of said calculated RPM exceeding said user selected engine RPM maximum value and a second value for the condition of the engine RPM no greater than the user selected engine RPM maximum value; and a power shunt for receiving said control signal and shunting the primary ignition coil to ground potential for a predetermined number of subsequent first spark signals for the condition of said control signal having said first value, and said power shunt terminating the shunting the primary ignition coil to ground potential for the condition of said control signal having said second value.

19. A second strike ignition system for generating a plurality of second spark signals from an ignition coil in an induction ignition system, the ignition coil having a primary coil winding and a secondary coil winding, and wherein a plurality of first spark signals is produced in the ignition coil primary winding by interrupting current flowing in one direction through the ignition coil primary coil winding, and each of said plurality of first spark signals having a predetermined polarity and a first predetermined duration determined by the main induction ignition system and each of said first spark signals having a predetermined voltage variable during at least a portion of the predetermined duration thereof, and only one of said plurality of second strike signals following each of said plurality of first strike signals, comprising, in combination:

a driver circuit connected to the ignition coil primary winding for reversing the direction of current flow in the ignition coil primary winding a predetermined time period subsequent to the start of each of said plurality of first spark signals, thereby producing one of said plurality of second spark signals in the ignition coil primary winding for each of said plurality of first spark signals.

20. The second strike ignition system as claimed in claim 19, wherein:

each of said plurality of first spark signals are of the same polarity as the following second spark signal.

21. The second strike ignition system as claimed in claim 19, comprising:

a peak detector determining the peak voltage of each of said plurality of first spark signals; and a limiter limiting the peak voltage of said one of said plurality of second spark signals to an amplitude no greater than that of the preceding first spark signal.

22. The second strike ignition system as claimed in claim 19, for generating a spark at a spark plug in an internal combustion engine, comprising:

a peak detector for determining the magnitude of the peak voltage of each of said first plurality of spark signals and generating a peak control signal in response thereto; and a comparator for receiving said peak control signal and comparing said peak voltage of each of said plurality of first spark signals with a predetermined threshold voltage and generating a comparator signal in response thereto; and, said generating arrangement for receiving said comparator signal and generating one of said plurality of second spark signals following each of said plurality of first spark signals for the condition of said first spark signal having a value less than said value of said predetermined threshold.

23. The second strike ignition system as claimed in claim 19 in an internal combustion engine, comprising:

a processor for calculating a crank-time-offset from a relationship between a user selected crank-angle-offset, the number of cylinders in the engine, and the instantaneous RPM of the engine; and, a driver circuit;

and said driver circuit operatively connected to the ignition coil for reversing the current through the ignition coil primary subsequent to a predetermined time delay from the start of each of said plurality of first spark signals, and said predetermined time delay substantially equal to the calculated crank-time-offset.

24. A method of creating a second strike spark signal output from an ignition coil in an induction ignition system, the ignition coil having a primary winding with positive connection terminal and negative connection terminal, and a secondary winding, a plurality of first spark signals generated in the ignition coil by the induction ignition system, said method comprising:

sensing the initiation of each of said plurality of first spark signals at the negative connection terminal of the ignition coil primary;

generating a plurality of second spark signals and each of said second spark signals having a peak voltage substantially the same as the peak voltage of the immediately preceding first spark signal, and only one of said plurality of second spark signals following each of said plurality of first spark signals, and each of said plurality of second spark signals delayed a predetermined time from the initiation of said immediately preceding first spark signal; and providing each of said plurality of second spark signals to the negative terminal of the ignition coil primary winding, thereby producing the second strike spark signal.

25. The method as claimed in claim 24, wherein:

each of said plurality of first spark signals and each of said plurality of second spark signals are of the same polarity.

26. The method as claimed in claim 24, wherein:

generating each of said plurality of said second spark signals a predetermined time period after the initiation of the immediately preceding first spark signal of said plurality of first spark signals.

27. The method as claimed in claim 24, applied to an internal combustion engine and generating said plurality of second strike signals throughout the RPM range of the engine, comprising:

calculating the RPM of the engine from the time interval between said sensed first spark signals;

comparing said calculated RPM with a user selected engine RPM maximum value; and activating a power shunt to shunt the negative connection terminal of the primary winding to ground potential for a predetermined number of subsequent spark signals for the condition of said calculated RPM greater than said user selected engine RPM maximum value;

continuing to shunt the negative connection terminal of the primary winding to ground potential until the engine RPM is not greater than the user selected engine RPM maximum value; and, deactivating said power shunt for the condition of said engine RPM not greater than said user selected RPM.

28. A second strike ignition system for creating a plurality of second strike spark signal outputs from an ignition coil in an induction ignition system, the ignition coil having a primary winding with a positive connection terminal and a negative connection terminal, and a secondary winding, and in which a plurality of first spark signals are generated in the ignition coil by the induction ignition system, said second strike ignition system comprising:

a sensor for sensing the initiation of each of said plurality of first spark signals at the negative terminal of the ignition coil primary; and a pulse generator for generating a plurality of second spark signals, and only one of said plurality of second spark signals following each of said plurality of first spark signals, and each of said plurality of second spark signals delayed from the immediately first spark signal and each of said plurality of second spark signals free of altering any of said plurality of first spark signals; and, applying each of said second spark signals to the negative connection terminal of the ignition coil primary winding, thereby producing said second strike spark signal.

29. The second strike ignition system as claimed in claim 28, wherein:

each of said plurality of said first spark signals and each of said plurality of said second spark signals are of the same polarity.

30. The second strike ignition system as claimed in claim 28, and further comprising:

said pulse generator for generating said only one of said plurality of said second spark signal a predetermined time period subsequent to initiation of said immediately preceding first spark signal.

31. The second strike ignition system as claimed in claim 28, applied to an internal combustion engine and generating said plurality of second spark signals throughout the RPM range of the engine, comprising:

a processor calculating the RPM of the engine from the time interval between successive first spark signals;

a comparator comparing said calculated RPM with a user selected engine RPM maximum value; and a power shunt for shunting the negative connection terminal of the primary winding to ground potential for a predetermined number of subsequent spark signals for the condition of said calculated RPM exceeding said user selected engine RPM maximum value, and said power shunt continuing to shunt the negative connection terminal of the primary winding to ground potential for the condition of the engine RPM not greater than said user selected engine RPM maximum value; and, control means for terminating shunting of the negative connection terminal of the primary winding to ground potential for the condition of said engine RPM not greater than said user selected engine RPM value.

32. A method of creating a plurality of second spark signals in an induction ignition system and the induction ignition system the type wherein there is generated a plurality of first spark signals and each of said plurality of first strike signals having a polarity and duration determined by a main induction ignition system, said method comprising:

sensing the initiation of each of said plurality of first spark signals and generating a plurality of enabling signals in response thereto and each of said enabling signals delayed a predetermined time interval from the start of the immediately preceding first spark signal;

generating one second spark signal in response to each of said plurality of enabling signals and said one second spark signal free of altering any of said plurality of first strike signals and said one second spark signal is delayed from the start of the immediately preceding first spark signal.

33. The method as claimed in claim 1, applied to an internal combustion engine, the primary induction ignition system having an induction ignition coil primary and a primary coil secondary, said method providing said second strike signals throughout the RPM range of the engine, comprising the steps of:

calculating the RPM of the engine from the time interval between successive first spark signals;

comparing said calculated RPM with a predetermined RPM threshold limit;

sensing the peak voltage of said first spark signal;

establishing said sensed peak voltage of said first spark signal as a reference voltage;

generating said second spark signal having a voltage substantially the same as said reference voltage for the condition of said calculated RPM having a value less than said predetermined RPM threshold limit; and, discontinuing the sensing of said peak voltage of said first spark signal for the condition of; and, setting the peak voltage of said second spark signal to a predetermined voltage value for the condition of said calculated RPM greater than said predetermined threshold RPM limit.

34. The method as claimed in claim 33, wherein:

said predetermined voltage value is the maximum peak voltage measured for the primary induction system.

35. The method as claimed in claim 34, further comprising the step of:

setting the peak voltage for the second spark signal to a fixed voltage level for the condition of the measured maximum peak voltage greater than a fixed voltage level.

36. The method as claimed in claim 33, comprising:

establishing a predetermined maximum voltage level;

measuring the peak voltage of said second spark signal;

determining the condition wherein the measured value of the peak voltage of said second spark signal exceeds said predetermined maximum voltage level; and decrementing the peak voltage of said second spark signal for the condition of the peak voltage of said second spark signal exceeding said predetermined maximum voltage level.

37. The method as claimed in claim 36, wherein:

said predetermined maximum voltage level is the maximum peak voltage measured for the primary induction system.

* * * * *